US007838798B2

(12) United States Patent
Uchikoshi

(10) Patent No.: US 7,838,798 B2
(45) **Date of Patent: *Nov. 23, 2010**

(54) SHIRT FINISHING MACHINE WITH FUNCTION FOR EXTENDING COLLAR

(75) Inventor: Mitsuyuki Uchikoshi, Tokyo (JP)

(73) Assignee: Sankousha Engineering Co., Inc. (JP)

( * ) Notice: Subject to any disclaimer, the term of this patent is extended or adjusted under 35 U.S.C. 154(b) by 1140 days.

This patent is subject to a terminal disclaimer.

(21) Appl. No.: 11/503,095

(22) Filed: Aug. 10, 2006

(65) Prior Publication Data

US 2008/0047947 A1 Feb. 28, 2008

(51) Int. Cl.
*H05B 3/02* (2006.01)

(52) U.S. Cl. ..... 219/243; 219/245; 219/246

(58) Field of Classification Search ..... 219/243, 219/245, 246; 99/421 V, 419, 345, 347; 38/12–13, 20–24; 223/35, 52, 74; 156/583.9
See application file for complete search history.

(56) References Cited

U.S. PATENT DOCUMENTS 2,619,267 A * 11/1952 Voigt ..... 223/2
2,886,221 A * 5/1959 Todd ..... 223/52.1
2,954,149 A * 9/1960 Lee ..... 223/52.1
3,144,969 A * 8/1964 Juraschek et al. ..... 223/74
3,749,292 A * 7/1973 Engelbart ..... 223/57
3,877,161 A * 4/1975 Engelbart ..... 38/17
3,979,248 A * 9/1976 Kussmaul ..... 156/358
4,004,720 A * 1/1977 Cartabbia ..... 223/57
4,026,444 A * 5/1977 Harjapaa ..... 223/37
4,058,055 A * 11/1977 Douglas ..... 101/10
7,000,340 B1 * 2/2006 Uchikoshi ..... 38/16

* cited by examiner

*Primary Examiner*—Tu B Hoang
*Assistant Examiner*—Brett Spurlock
(74) *Attorney, Agent, or Firm*—Andrus, Sceales, Starke & Sawall, LLP

(57) ABSTRACT

A collar iron buck on which the collar of a shift is mounted while being extended in a lateral direction and a press iron for press finishing the collar while pressing against the upper surface of the collar iron buck includes surface corresponding to the central part of the collar in its longitudinal direction that is notched in inverse triangular-shape as seen from a front elevational view. The right and left portions of the supper surface are communicated with the upper surface corresponding to the central part of the collar and corresponding to both ends of the collar in its longitudinal direction are formed into two horizontal plates. First resilient members support the right and left horizontal plates with a resilient pressure selected to be larger than the resilient pressure of second resilient members supporting the inverse triangular-shaped upper surface of the collar iron buck.

6 Claims, 8 Drawing Sheets

SHIRT FINISHING MACHINE WITH FUNCTION FOR EXTENDING COLLAR

BACKGROUND OF INVENTION

1. Field of Invention

This invention relates to a shirt finishing machine for use in press finishing a shirt such as a washed white shirt and the like, and more particularly a shirt finishing machine having a collar extending function for extending neatly the collar shrunk through its washing to enable it to be press finished.

2. Description of Related Art

As this type of prior art shirt finishing machine, there has been provided the machine described in the gazette of U.S. Pat. No. 7,000,340, for example. This type of prior art shirt finishing machine is formed such that the upper surface position of a collar iron buck where the collar of a shirt is extended wide in a lateral direction is notched in an inverse triangular shape as seen from its front elevational view, the collar at its lateral position communicating with this upper surface position and corresponding to both ends of the collar in its longitudinal direction is formed into a horizontal surface, and when the upper surface of the collar iron buck is pressed with the press irons, it is fallen into a flat surface shape.

In such a case as above, this type of shirt finishing machine is operated to depress the collar into a flat surface by a press iron having a flat iron surface and a collar iron buck fallen into a flat surface state through a pressing operation of this press iron.

However, the prior art machine has been constituted in such a way that the upper surface of the color iron buck is supported by a coil spring under the same spring pressure state for entire upper surface. Due to this fact, when the press iron pressed against the upper surface of the collar iron buck, the collar was held and fixed at the horizontal lateral position of the collar iron buck and the iron surface of the press iron and the upper surface of the iron buck was fallen. Accordingly, in accordance with the prior art machine, the location of the collar corresponding to the inverse-triangular shaped upper surface position of the collar iron buck was pulled in a lateral direction and the entire collar could not be pulled and extended in a lateral direction under a well-balanced state.

The present invention has been provided in view of some prior art problems as described above.

Accordingly, the technical themes to be solved by the present invention provide a shirt finishing machine having a collar expanding function in which the collar iron buck is fallen into a flat surface shape position through the pressing operation of the press iron and the collar is press finished into a flat surface shape, and the collar is expanded in the same rate over its entire length and the collar can be neatly press finished.

SUMMARY OF INVENTION

The present invention is formed to be provided with a collar iron buck for use in laterally expanding a collar of a shirt and putting it on the collar iron buck, and a press iron for pressing against the upper surface of the collar iron buck to, press finish the collar. The upper surface position of the collar iron buck corresponding to the longitudinal central part of the collar is notched in an inverse triangular shape as seen from the front view. The lateral position communicated with the upper surface position and corresponding to both ends of the collar in the longitudinal direction are formed into a horizontal surface and when the upper surface of the collar iron bucks are pressed by the press iron, they are fallen into a flat surface.

In addition, the iron surface of the press irons are formed into a flat surface. In such a shirt finishing machine as described above, the present invention is set such that a resilient pressure of a resilient member supporting the lateral position of the collar iron is selected to be larger than a resilient pressure of the resilient member supporting the upper surface position of the inverse-triangular shape of the collar iron bucks.

Since the present invention is constituted as described above, when the press irons press against the upper surface of the collar iron bucks, lateral ends of the collar are fixed, the collar can be extended in a lateral direction under this state as the collar iron bucks are fallen, and can be press finished.

Accordingly, in accordance with the present invention, both the front side and rear side of the collar shrunk by its washing can be extended over an entire lateral direction of the collar and the collar can be finished clean.

The expression of "can be formed into a flat surface and fallen" is meant by the fact that when the upper surface of the collar iron buck receives a pressing force by the press iron, it is fallen into a flat surface and as the pressing force is removed, it is recovered. As the resilient member, there may be applied such as a compressed coil spring, leaf spring, damper and rubber or the like, for example. Although the resilient member for supporting the lateral position of the collar iron buck is usually arranged at the end part of the collar iron buck, it may also be applicable that it can be arranged at a position near more inwardly than the end part of the collar iron buck in correspondence with the lateral ends of the collar. In addition, the resilient member for supporting the upper surface position of the inverse-triangular shape of the collar iron buck is arranged just below the upper surface position or the position of an interface between the upper surface position and the lateral position, for example. In this case, the resilient pressure is meant by a recovering force in which the spring returns back to its original state when the coil spring is compressed with the pressing force of the press iron and deformed. As a difference between the resilient members, it may be properly selected in compliance with some characteristics such as the type or thickness of collar cloth and extending or shrinkage of the collar caused by its material quality and the like.

Thus, it is preferable for the present invention to be formed such that the lateral position of the upper surface of the collar iron buck is received when this upper surface is fallen and at the same time there is provided a protruded step heat transfer part for transmitting heat to the upper surface to heat it.

Because, with this arrangement as above, when the press iron is fallen onto the upper surface of the collar iron buck, heat is applied to the collar from above and below in cooperation with the press iron and the collar can be press finished rapidly and neatly. The heat transferring part is usually formed in such a way that steam is supplied inside the heat transferring part and the heat of steam is transferred to the upper surface of the collar iron buck. However, the heat transferring part is not limited to such a configuration as above, but it may be formed such that the heater is stored in it, for example. In addition, in case of the present invention, a forming position, number and shape of the heat transferring part as seen from its top plan view or the like can be set as features that are properly selected.

In addition, the shirt finishing machine of the present invention can be applied as one in which the upper surface of the collar iron buck is covered by a mat-like cover in which the resilient surface member of resin or rubber is covered by cloth, and the lower surface position of the resilient surface member corresponding to the inverse triangular-shaped upper surface position of the aforesaid collar iron buck and the resilient surface member is abutted against the lateral position of the horizontal surface of the collar iron buck.

The cover covering the upper surface of collar iron buck in the prior art was formed to cover the entire resilient surface member with a cloth. Due to this fact, there occurred a situation in the past that when the press iron presses against the upper surface of the collar icon buck, the resilient surface member was pulled or locally shrunk, for example, due to a difference in coefficient of friction between the cloth and the resilient surface member and a bad influence was applied to the finishing of the collar. The present invention can resolve such problems as above. Because, in case of the present invention, the resilient surface member can be extended freely in correspondence with the falling operation of the upper surface of the collar iron buck while it is being held with a cloth at a position corresponding to the inverse triangular-shaped upper surface position of the collar iron buck. It is satisfactory that the resilient surface member is a resilient sheet-like or mat-like member and more practically it may be made of silicone rubber or synthetic rubber and elastomer and the like.

In addition, it is preferable that the shirt finishing machine of the present invention is constituted such that the inverse triangular-shaped upper surface position of the collar iron buck is formed by a pair of right and left plates, the pivoted ends of the pair of right and left plates are formed into a rectangular wave shape as seen from a top plan view, the pair of right and left plates cause the convex end part and concave end part to be engaged to each other and they are connected at the pivot shaft.

Because, in accordance with this arrangement, a length of the clearance formed at the connected location of a pair of right and left plates and extending in a forward and rearward direction of it as seen from its top plan view can be shortened and the press pressure can be dispersed more as compared with the case that of this type of long clearance. Further, in this case, it is possible to reduce a trace of iron placed at the central part of the collar.

BRIEF DESCRIPTION OF DRAWINGS

FIG. 1A is a substantial perspective view for showing a state of use and FIG. 1B is a substantial top plan view for showing a collar set state.

DESCRIPTION OF PREFERRED EMBODIMENTS

Figure 1A:
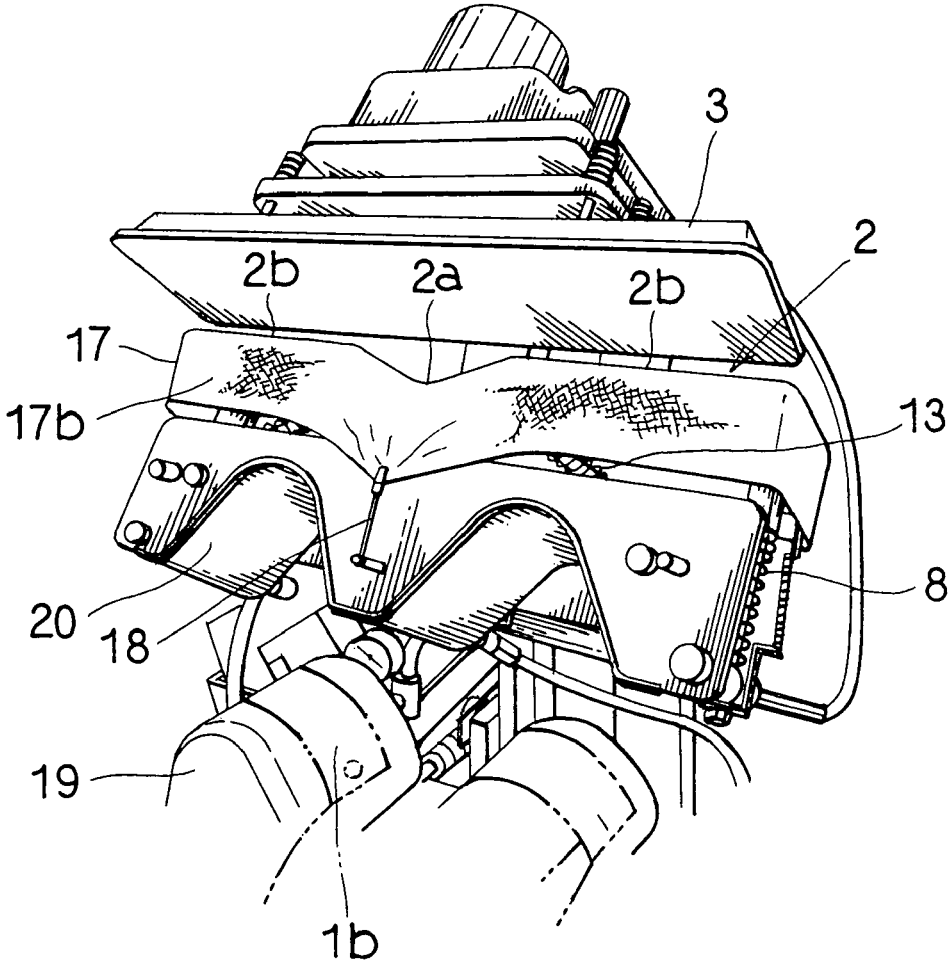
FIGS. 1A and 1B show one preferred embodiment of the shirt finishing machine of the present invention.

Referring now to the drawings, the preferred embodiments of the present invention will be described.

As shown in FIG. 1 or the like, the shirt finishing machine of the present invention is formed to comprise a collar iron buck 2 in which a collar 1*a* of a shirt 1 is extended laterally and mounted on it and a press iron 3 for pressing collar 1*a* against the upper surface of the collar iron buck 2. An iron surface of the press iron 3 is formed into a flat surface.

Figure 5:
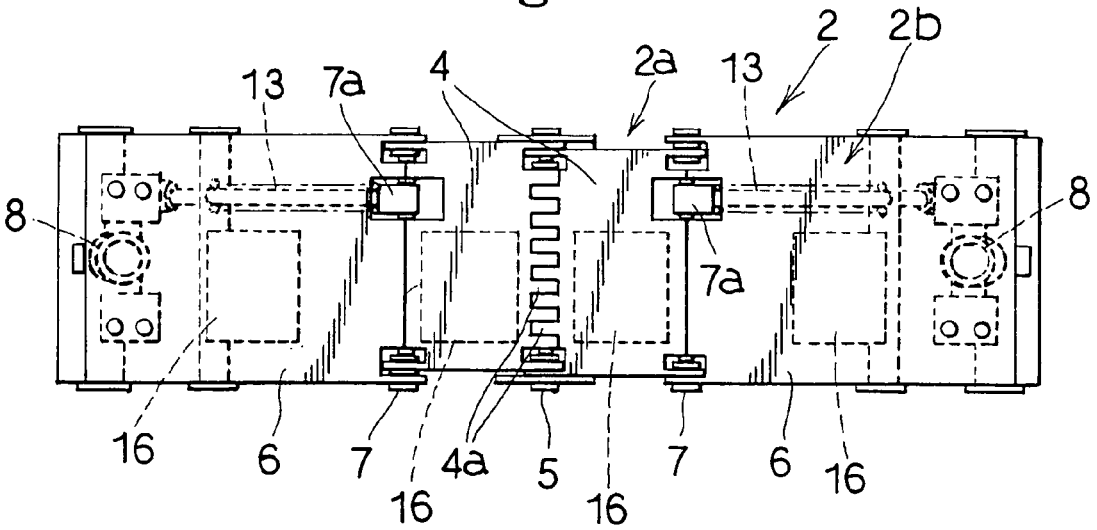
FIG. 5 is a top plan view for showing a collar iron buck with the cover being removed from it.
Figure 6:
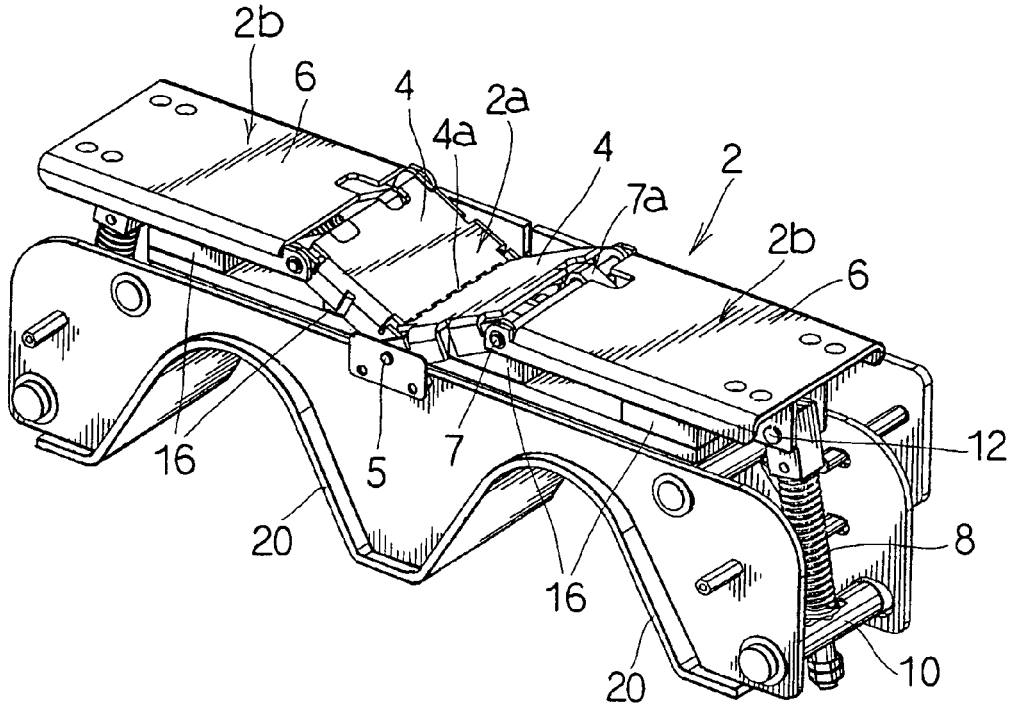
FIG. 6 is a substantial perspective view for showing a collar iron buck with the cover being removed from it.

As shown in FIGS. 5 and 6, the upper surface position 2*a* of the collar iron buck 2 corresponding to the central part of the collar 1*a* in its longitudinal direction is set such that a pair of right and left plates 4 are pivotally connected at a pivot shaft 5 and they are formed into an inverse triangular shape as seen from its front elevational view. The ends 4*a* at the side of the pivoted portions of the pair of right and left plates 4 are formed into a rectangular wave shape as seen from their top plan view, the pair of right and left plates 4 are connected by the pivot shaft 5 to each other while the convex portions and concave portions of the ends 4*a* are being engaged to each other.

In addition, the upper surface of the collar iron buck 2 is set such that the right and left position 2*b* corresponding to both ends of the collar 1*a* in its longitudinal direction are formed into a horizontal surface. As shown in FIGS. 5 and 6 or the like, the pair of right and left plates 4 are pivoted at their side ends to the horizontal plates 6 forming the right and left position 2*b* in the upper surface of the collar iron buck 2 through joint shafts 7.

Figure 8:
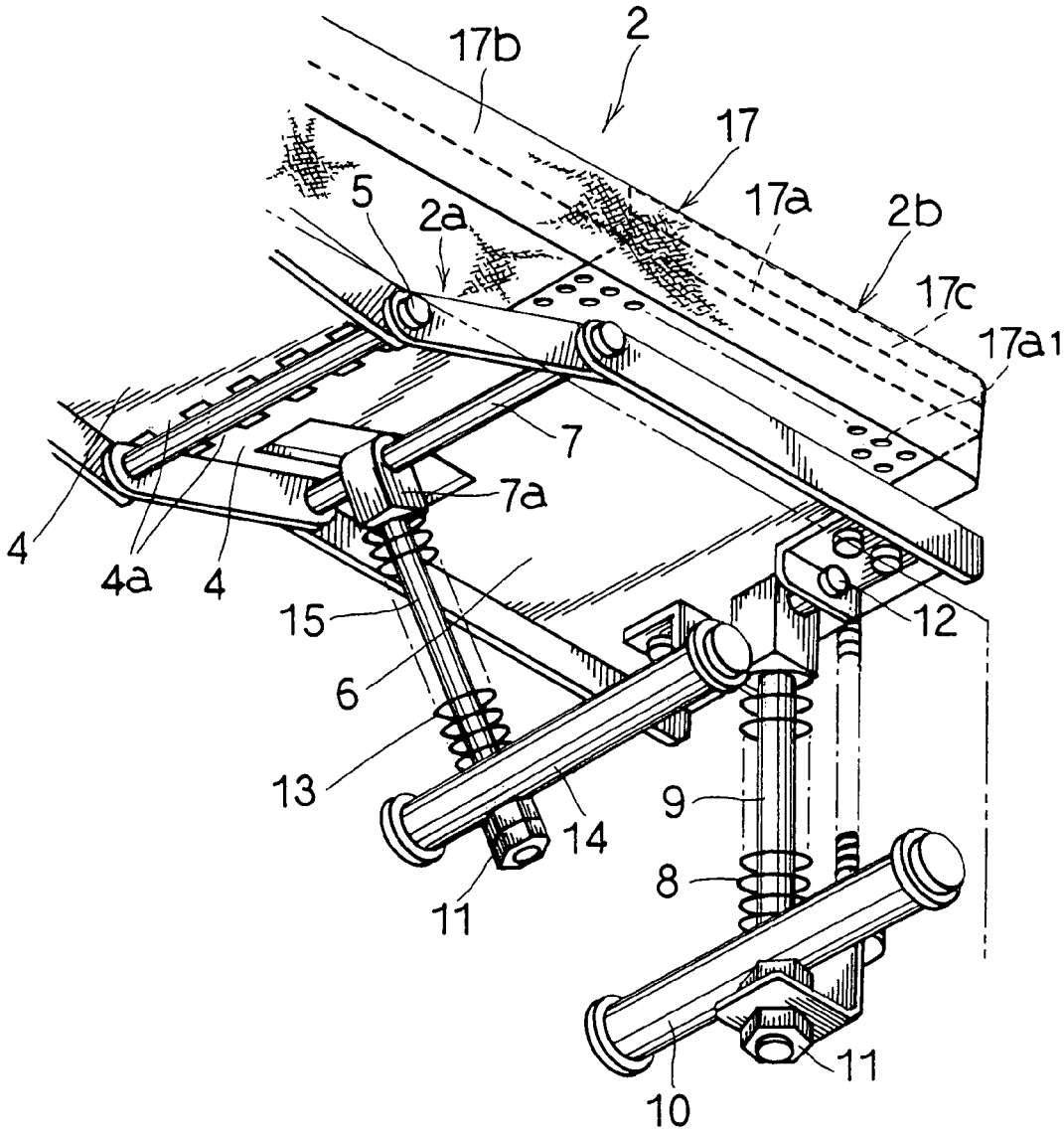
FIG. 8 is a substantial perspective view for showing the collar iron buck.

In addition, in the case of the present invention, the upper surface of the collar iron buck 2 are formed such that they may be fallen into the flat surface shape when they are pressed with the press iron 3. Reference numeral 8 denotes a first coil spring acting as a resilient member for supporting the right and left position 2*b* of the collar iron buck 2. The first coil springs are arranged at the terminal ends of the horizontal plate 6, outwardly fitted to a raised first metallic rod 9 (refer to FIG. 8 or the like), the lower part of the first metallic rod 9 is inserted into a first supporting rod 10 in such a way that the rod can be moved up and down, and its removal is stopped by a nut 11. In addition, the upper end of the first metallic rod 9 is pivoted to the horizontal plate 6 through a lateral shaft 12 extending in a forward and rearward direction.

In addition, reference numeral 13 (refer to FIG. 8 or the like) denotes a second coil spring acting as a resilient member for supporting the inverse triangular-shaped upper surface position 2*a* of the collar iron buck 2. This second coil spring is outwardly fitted to an inclined second metallic rod 15 connected to a joint block 7*a* and arranged between the joint block 7*a* of the joint shaft 7 and the second supporting rod 14 laterally installed along a forward or rearward direction of the collar iron buck 2. The lower part of the second metallic rod 15 is inserted into the second supporting rod 14 in such a way that it may be moved up and down and its removal is stopped by the nut 11. Then, a resilient pressure of the first coil spring acting as the resilient member 8 is selected to be larger than a resilient pressure of the second coil spring acting as the resilient member 13 for use in supporting the inverse triangular-shaped upper surface position 2*a* of the collar iron buck 2.

Figure 7:
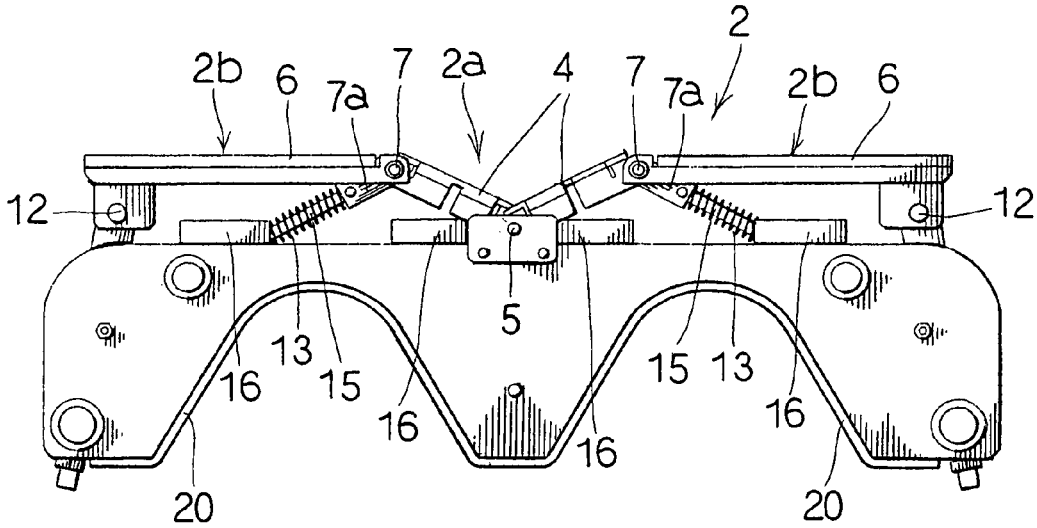
FIG. 7 is a substantial front elevational view for showing a collar iron buck with the cover being removed from it.

Reference numeral 16 (refer to FIGS. 5 to 7 or the like) denotes convex-stepped heat transfer segments for receiving the right and left position 2*b* of the upper surface when the upper surface of the collar iron bucks 2 are fallen and transferring heat to the upper surface to heat them. The heat transfer segments 16 are arranged below the upper surface position 2*a* and the right and left position 2*b*. In addition, in case of this preferred embodiment, the heat transferring segments 16 are formed into a rectangular block shape as seen from its top plan view and steam is supplied into it.

Figure 11:
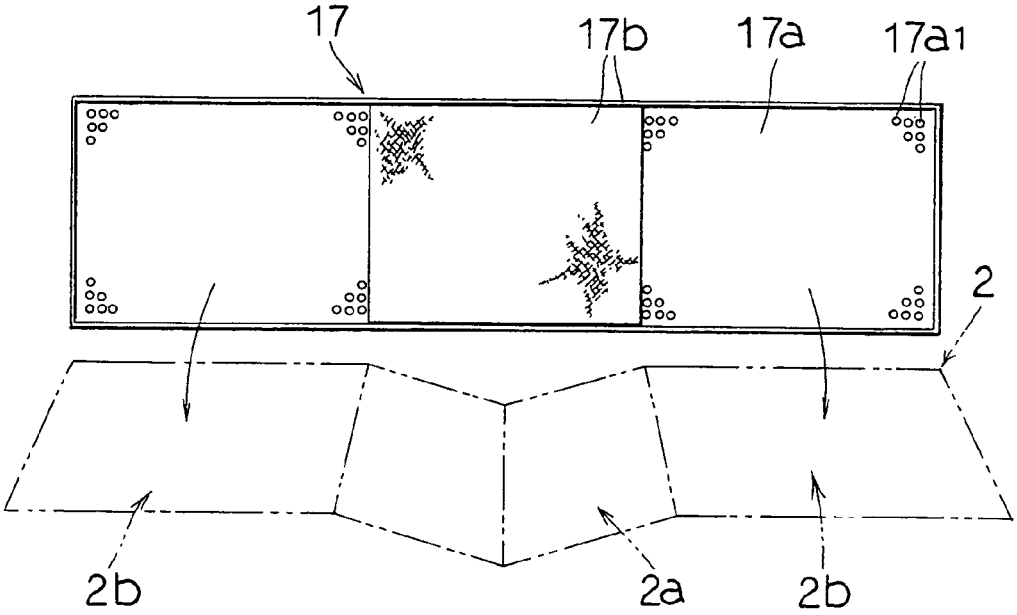
FIG. 11 is a bottom view for showing a state in which the cover is seen from its rear side.
Figure 12:
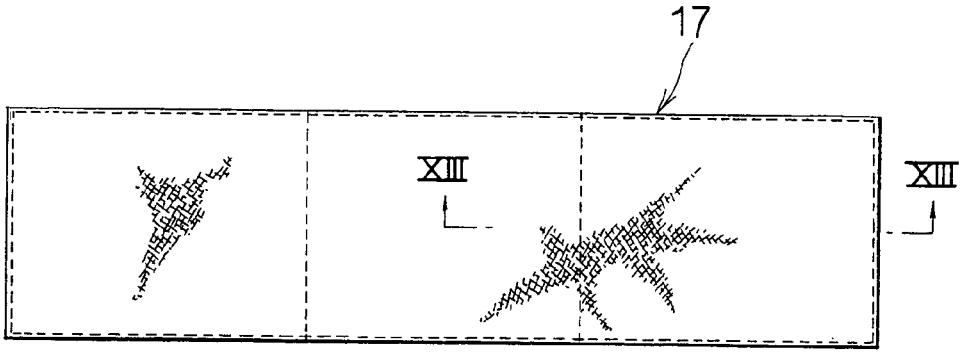
FIG. 12 is a top plan view for showing the cover.

Thus, the upper surface of the collar iron buck 2 is covered by the mat-like cover 17. This cover 17 in this preferred embodiment is formed such that the resilient surface member 17*a* (refer to FIGS. 11 to 13 or the like) of silicone rubber is covered by a cloth 17*b*. The lower surface position of the resilient surface member 17*a* corresponding to the inverse triangular-shaped upper surface position 2*a* of the collar iron buck 2 is enclosed by the aforesaid cloth 17*b*. Then, the resilient surface member 17*a* is arranged such that it is directly struck against the horizontal surface right and left position 2*b* of the collar iron buck 2. In addition, the resilient surface member 17*a* has many holes 17*a*1 passing through it in an upward or downward direction.

Figure 13:
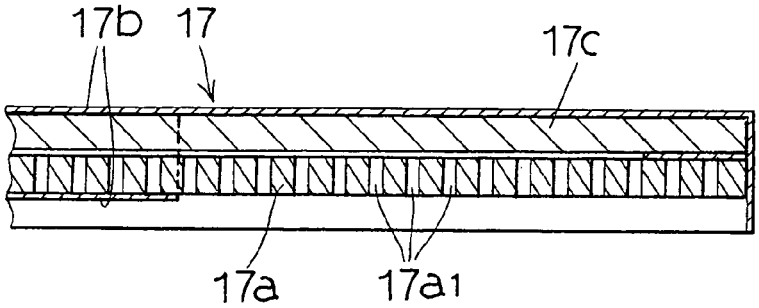
FIG. 13 is a substantial enlarged sectional view taken along XIII-XIII in FIG. 12.

In this preferred embodiment, the cover 17 is formed such that the upper side of the resilient surface member 17*a* is provided with a flannel surface member 17*c* (refer to FIG. 13). Then, as shown in FIG. 1A, the cover 17 is fixed in tension to the upper surface of the collar iron buck 2 by a method wherein the cloth 17*b* is pulled downward by the pulling member 18 at the central forward or rearward position or both side position or the like of the collar iron buck 2.

Figure 2:
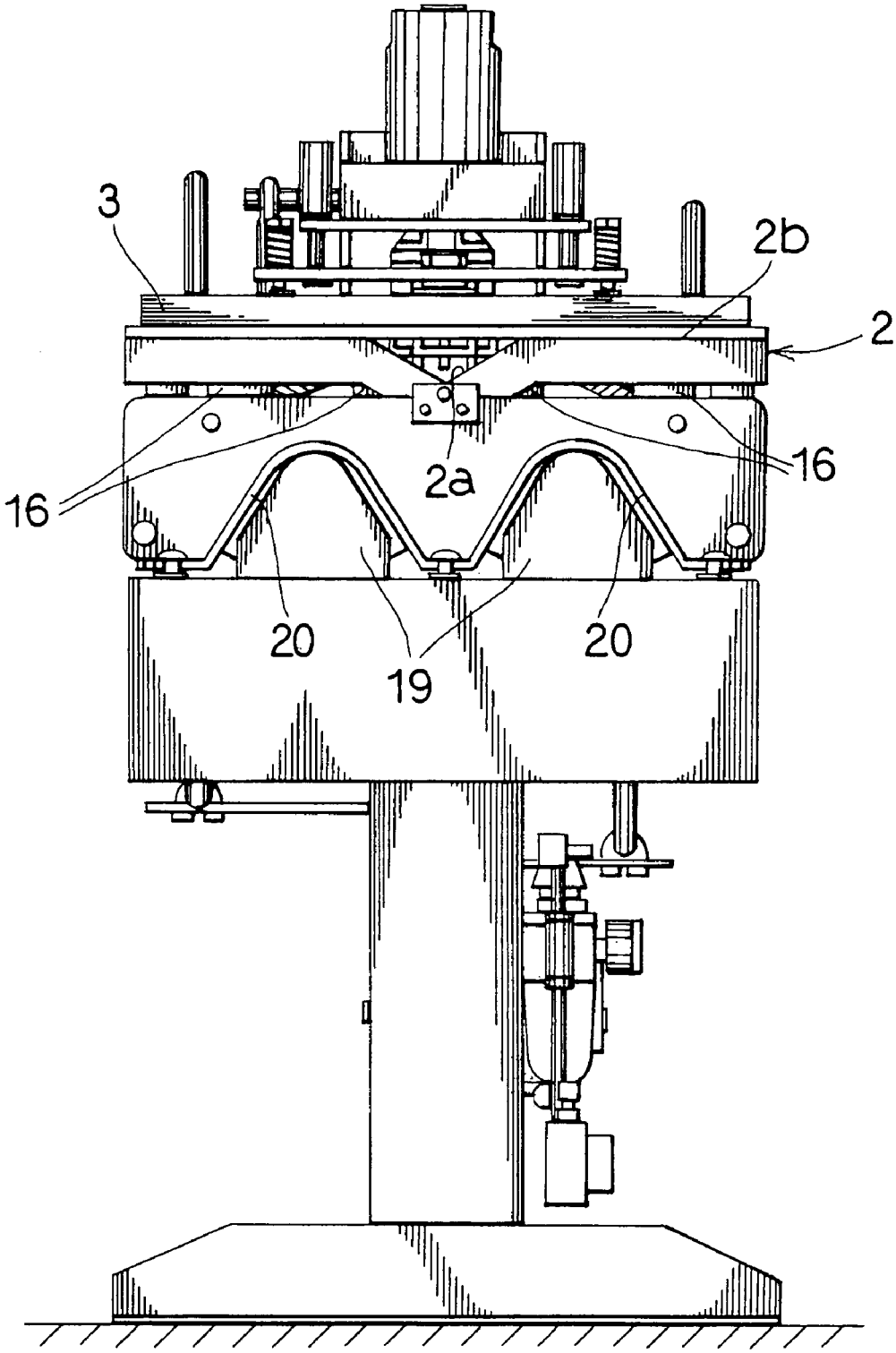
FIG. 2 is a front elevational view for showing the shirt finishing machine.

Reference numeral 19 (refer to FIGS. 1A and 2 or the like) denotes an iron buck for a mountain-shaped cuff for use in setting a cuff 1*b* of the shirt 1. A pair of right and left iron bucks 19 for cuff are arranged below the collar iron buck 2. In addition, reference numeral 20 denotes an iron part for pressing against the upper surface of the cuffs iron buck 19. This iron part 20 is formed at the lower surface of the collar iron buck 2 while being concaved in a mountain-shaped in an upward direction. The collar iron buck 2 is formed such that it may be turned in an upward or downward direction around the fulcrum point 22 through an extending or retracting operation of the rod in the cylinder device 21 (refer to FIG. 3) arranged to be raised.

Figure 3:
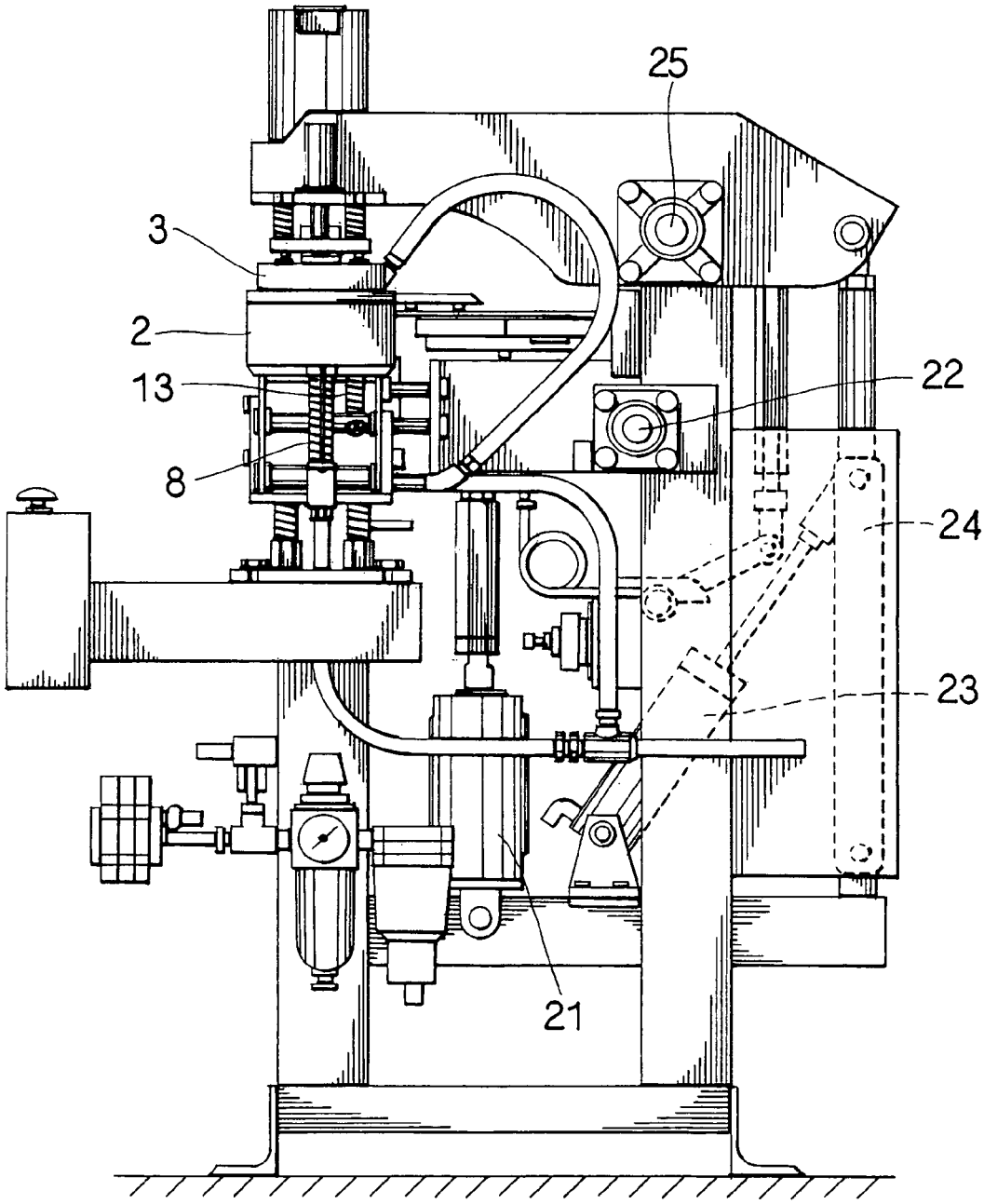
FIG. 3 is a right side elevational view for showing the shirt finishing machine.
Figure 4:
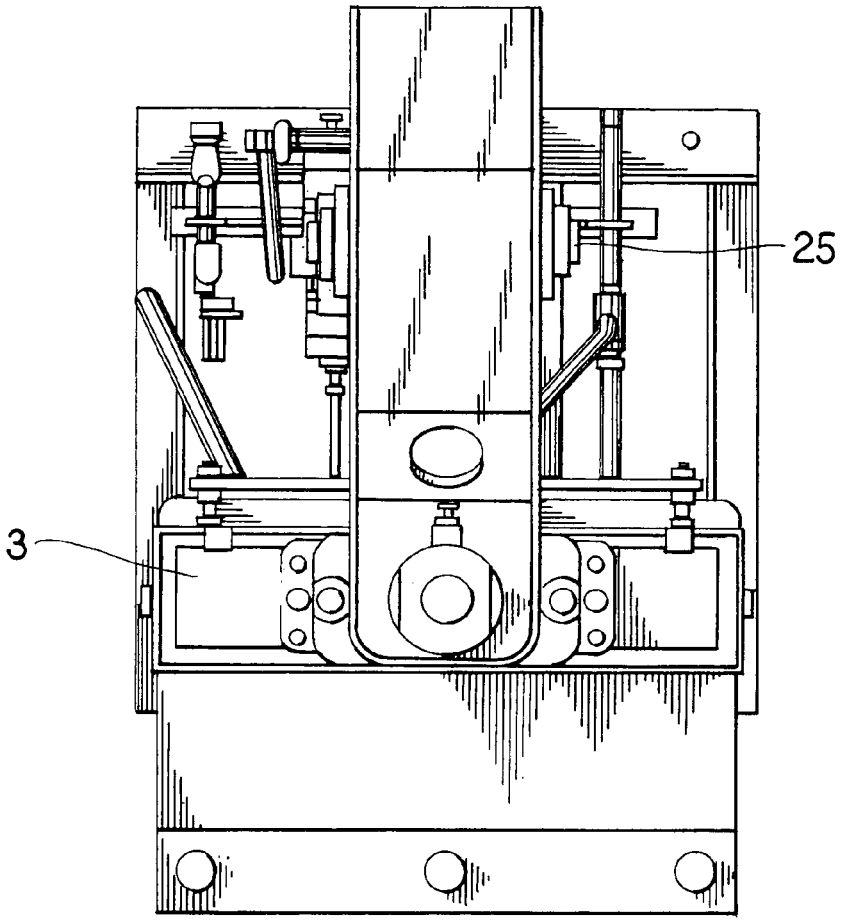
FIG. 4 is a top plan view for showing the shirt finishing machine.

In addition, reference numeral 23 in FIG. 3 denotes an operating cylinder for the press iron 3. When the rod in the operating cylinder 23 is extended, the press iron 3 is turned around the pivoted part 25 through the link mechanism 24 in an upward or downward direction to depress against the collar iron buck 2 and at the same time to depress the lower side cuff iron buck 19 through the collar iron buck 2.

Then, an action of the present invention in accordance with this preferred embodiment will be described as follows.

At first, the operator sets the cuff 1*b* of the shirt 1 to the cuff iron buck 19 as shown in FIG. 1A. Then, the operator depresses a start button. Then, the rod in the cylinder device 21 (refer to FIG. 3) is retracted, the collar iron buck 2 descends and the iron part 20 depress against the cuff iron buck 19.

Figure 1B:
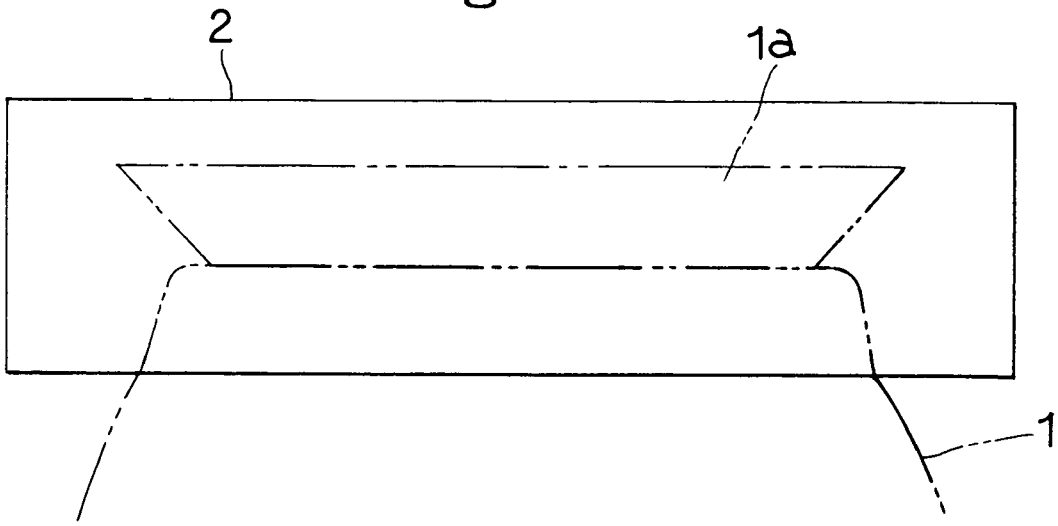
Figure 9:
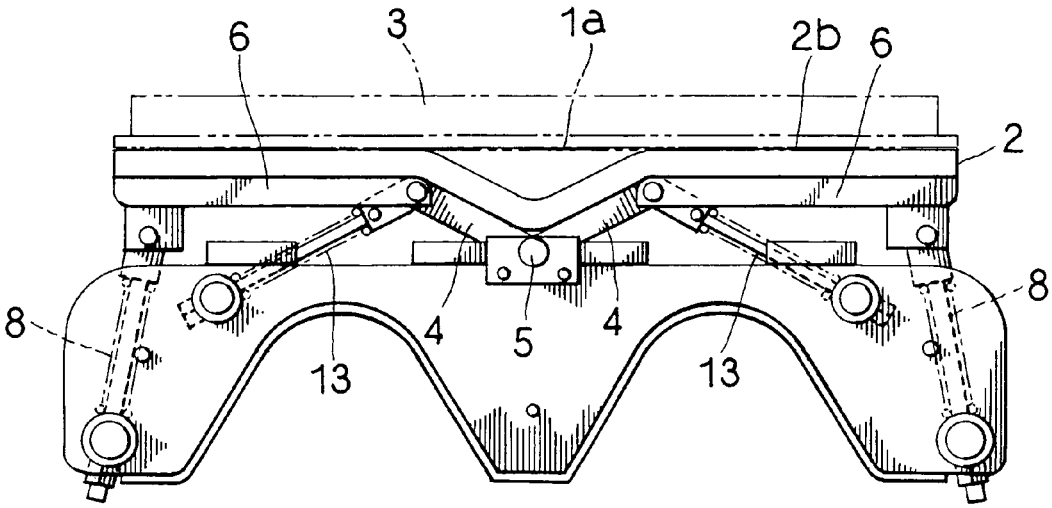
FIG. 9 is a substantial front elevational view for illustrating an action of the shirt finishing machine.
Figure 10:
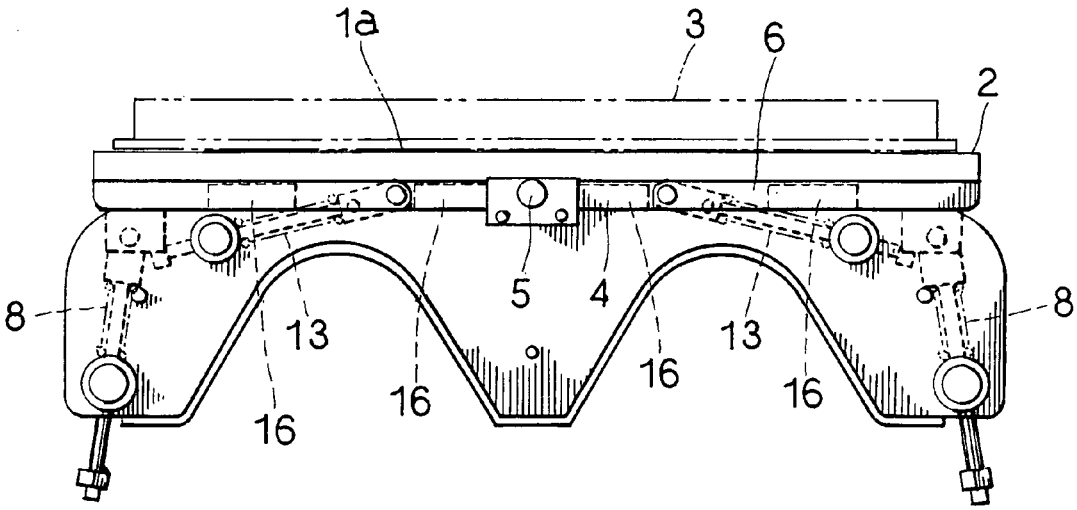
FIG. 10 is a substantial front elevational view for illustrating an action of the shirt finishing machine.

Then, as shown in FIG. 1B, the operator expands the collar 1*a* of the shirt 1 laterally onto the upper surface of the collar iron buck 2 and sets the collar. Then, the operator depresses the switch. Then, the rod in the operating cylinder 23 (refer to FIG. 3) extends and the press iron 3 turns around the pivoted part 25 in a downward direction. Then, when the press iron 3 depresses against the upper surface of the collar iron buck 2 against a resilient force of the resilient members 8, 13 (refer to FIG. 9), the pair of right and left plates 4 are lowered, turned around the pivot shaft 5 and pushed down, the horizontal plates 6 at the right and left position 2*b* corresponding to both ends of the collar 1*a* are gradually depressed down while moving slightly in an outward direction, and finally the plates 4 and the horizontal plates 6 are fallen into a flat surface state (refer to FIG. 10).

In this case, a resilient pressure of the resilient member 8 in the present invention is selected to be larger than a resilient pressure of the resilient member 13. Accordingly, in accordance with the present invention, at first, the press iron 3 fixes the right and left ends of the collar 1*a* and presses the collar 1*a* while expanding it in a lateral direction.

In addition, when the press iron 3 makes the upper surface of the collar iron buck 2 fall, the upper surface of the collar iron buck 2 abuts against the heat transfer portions 16 and then the upper surface of the collar iron buck 2 is heated by the heat transfer portions 16. As a result, the collar 1*a* is applied with heat from above by the press iron 3 and from below by the upper surface of the collar iron buck 2 and then the collar is press finished fast and neatly.

Thus, in the present invention, when the press iron 3 depresses against the collar iron buck 2, the press pressure is also added to the cuff iron buck 19 (refer to FIGS. 1A and 2). Accordingly, the iron part 20 depress against the cuffs 1*b*, and the collar 1*a* and cuffs 1*b* are concurrently press finished.

With such an arrangement as above in the present invention, it is also applicable that the cuff iron buck 19 is eliminated. In addition, also when the cuff iron buck 19 is installed to form the present invention, the buck is not limited to the lower side of the collar iron buck 2, but the bucks can be arranged at both sides of the collar iron buck 2 in the same manner as that of this type of prior art finishing machine. In addition, it may also be applicable that the collar iron buck 2 is constructed such that the resilient members 8, 13 are composed of a leaf spring or a damper and the like and freely fallen into a flat state.

The shirt finishing machine of the present invention is constituted such that the lateral width of each of the inverse triangular-shaped upper surface position 2*a* of the collar iron buck 2 is formed narrow and the collar 1*a* can be set without requiring any receiving plate already described in the Patent Document 1. Accordingly, in accordance with the present invention, it is possible to eliminate the receiving plate or the receiving plate removal mechanism of the prior art machine and correspondingly the product can be provided in less-expensive price.

What is claimed is:

1. A shirt finishing machine with a function for extending a collar, comprising a collar iron buck on which the collar of a shirt is mounted while being extended in a lateral direction and a press iron for press finishing the collar while pressing against an upper surface of the collar iron buck, a central part of the upper surface of the collar iron buck corresponding to a central part of the collar in its longitudinal direction is notched to provide an inverse triangular-shape in a plane through said central part perpendicular to the upper surface of the collar iron buck, the upper surface having right and left horizontal plates communicated with the upper surface of the collar iron buck corresponding to the central part of the upper surface, said horizontal plates corresponding to both ends of the collar in the longitudinal direction of the collar, said plates formed into a horizontal surface shape, and when the upper surface of the collar iron buck is depressed with the press iron, the iron is set to be a flat surface shape and the iron surface of said press iron is formed into a flat surface shape, wherein first resilient members support the right and left horizontal plates of said collar iron buck upper surface and second resilient members support the inverse triangular-shaped upper surface of the collar iron buck, the first resilient members having a resilient pressure larger than a resilient pressure of the second resilient members.

2. The shirt finishing machine with a function for extending a collar according to claim 1, wherein there are provided protruded step heat transfer parts for receiving the right and left horizontal plates of the upper surface of the collar iron buck when the upper surface of the collar iron buck is set to a flat state, said heat transfer parts transferring heat to the upper surface and heating the plates.

3. The shirt finishing machine with a function for extending a collar according to claim 1, wherein the upper surface of the collar iron buck is covered by a mat-like cover having a resilient surface member or resin or rubber covered by a cloth, a lower surface position of the resilient surface member corresponding to the inverse triangular-shaped central part of the upper surface of said collar iron buck is enclosed by said cloth and the resilient surface member is abutted against the right and left horizontal plates of the upper surface of the collar iron buck.

4. The shirt finishing machine with a function for extending a collar according to claim 2, wherein the upper surface of the collar iron buck is covered by a mat-like cover having a resilient surface member of resin or rubber covered by a cloth, a lower surface position of the resilient surface member corresponding to the inverse triangular-shaped central part of the upper surface of said collar iron buck is enclosed by said cloth and the resilient surface member is abutted against the right and left horizontal plates of the upper surface of the collar iron buck.

5. The shirt finishing machine with a function for extending a collar according to claim 1, wherein the inverse triangular-shaped central part of the upper surface position of the collar iron buck is formed by a pair of right and left central plates, adjacent end parts of the pair of right and left central plates are formed into rectangular interengaging wave shapes in a plane through said adjacent end parts parallel to the upper surface of the collar iron buck, the pair of right and left central plates are connected by a pivot shaft with their end parts being engaged to each other.

6. The shirt finishing machine with a function for extending a collar according to claim 4, wherein the inverse triangular-shaped central part of the upper surface position of the collar iron buck is formed by a pair of right and left central plates, adjacent end parts of the pair of right and left central plates are formed into rectangular interengaging wave shapes in a plane through said adjacent end parts parallel to the upper surface of the collar iron buck, the pair of right and left central plates are connected by a pivot shaft with their end parts being engaged to each other.

* * * * *